United States Patent [19]

Urisaka

[11] 4,134,598

[45] Jan. 16, 1979

[54] LAND SKIS

[76] Inventor: Yukihiro Urisaka, 86 Prospect Park W., Brooklyn, N.Y. 11215

[21] Appl. No.: 868,301

[22] Filed: Jan. 10, 1978

[51] Int. Cl.[2] ..... A63C 17/06; A63C 17/18

[52] U.S. Cl. ..... 280/11.22; 280/7.13; 280/11.1 BT; 280/11.27

[58] Field of Search ..... 280/11.22, 11.23, 11.1 BT, 280/11.27, 7.13, 11.19

[56] References Cited

U.S. PATENT DOCUMENTS

| | | | |
|---|---|---|---|
| 214,563 | 4/1879 | Harwood | 280/7.13 |
| 988,533 | 4/1911 | Zverina | 280/11.23 |
| 1,778,850 | 10/1930 | Duisenberg | 280/11.22 |
| 2,048,916 | 7/1936 | Bentzlin | 280/11.22 |
| 2,253,012 | 8/1941 | Benner et al. | 280/11.1 BT |
| 2,664,294 | 12/1953 | Kleinman | 280/11.27 |
| 2,868,553 | 1/1959 | Rieckman | 280/7.13 |
| 3,512,796 | 5/1970 | Mangus | 280/11.22 |
| 3,722,900 | 3/1973 | Dickert | 280/11.1 BT X |
| 3,827,706 | 8/1974 | Milliman | 280/11.1 BT |

FOREIGN PATENT DOCUMENTS

| | | | |
|---|---|---|---|
| 363083 | 9/1938 | Italy | 280/11.22 |
| 443881 | 1/1936 | United Kingdom | 28/7.13 |

*Primary Examiner*—Joseph F. Peters, Jr.
*Assistant Examiner*—Milton L. Smith
*Attorney, Agent, or Firm*—Steinberg & Blake

[57] ABSTRACT

A land ski has an elongated support simulating a conventional snow ski and having an upper surface carrying a conventional ski-binding, as well as an opposite lower surface and front and rear ends, the elongated support having a longitudinal central axis situated in a substantially upright plane during use of the land ski. Only three wheels are situated beneath the lower surface of the elongated support while being connected thereto by three connecting structures, the three wheels including front and rear wheels as well as an intermediate wheel. The rear wheel is situated closer to the rear end of the support than a ski shoe which is held on the upper surface of the support by the ski binding, while the intermediate wheel is situated beneath a part of the support which is situated beneath a ski-shoe held on the support by the ski binding. These intermediate and rear wheels are connected to the support only for rotary movement about their central substantially horizontal axes which extend transversely with respect to the support while being normal to the above upright plane, the latter passing midway through the intermediate and rear wheels so that the latter are symmetrical with respect to this plane. The front wheel is situated at a substantial distance forwardly of the intermediate wheel and while being substantially similar thereto is connected to the support not only for rotary movement about its substantially horizontal axis but also for swivelling movement about an upright axis situated in the above upright plane which also extends midway through the front wheel during normal forward straight travel of the support.

12 Claims, 10 Drawing Figures

FIG. 6
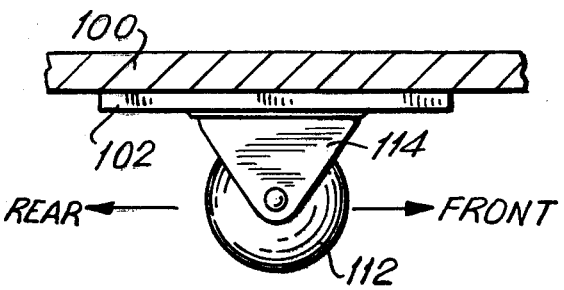
FIG. 7
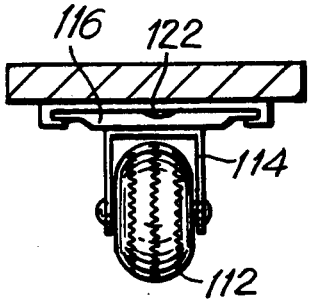
FIG. 8
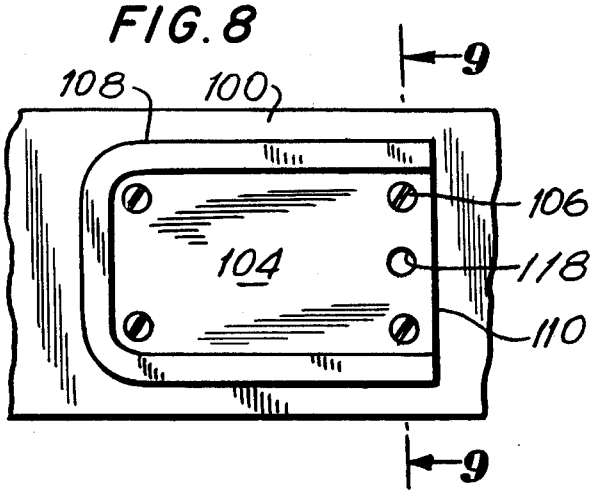
FIG. 9
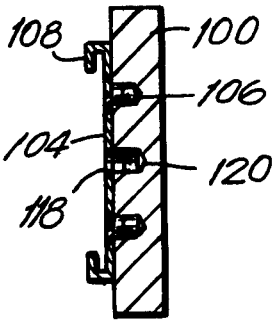
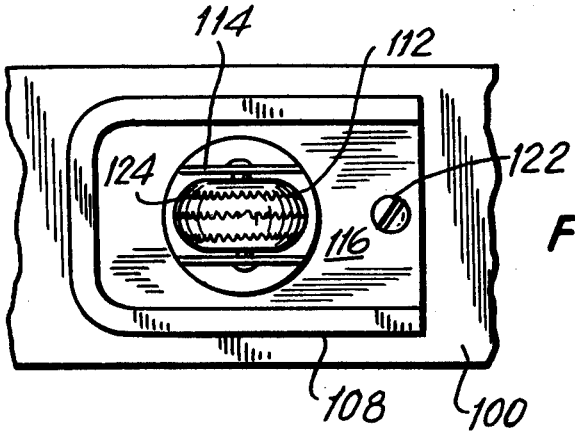
FIG. 10

LAND SKIS

BACKGROUND OF THE INVENTION

The present invention relates to land skis.

Thus, the present invention relates to skis provided with wheels enabling skis to travel on surfaces such as hard terrain on which there is no snow or ice.

Land skis of this general type are known, but up to the present time they have not achieved any considerable popularity because the conventional land skis suffer from a number of drawbacks. Thus, conventional land skis are difficult to maneuver. Thus, while certain types of known land skis may perhaps be able to travel along a straight path in a foward direction, difficulties are encountered with respect to conventional land skis when attempts are made to execute turns. Such maneuvering of conventional land skis involves operations considerably different from conventional snow skis so that an attempt in climates where there is no winter snow to utilize land skis does not succeed in providing anything which even closely simulates the use of conventional snow skis.

SUMMARY OF THE INVENTION

It is accordingly a primary object of the present invention to provide land skis which will avoid the above drawbacks.

A further object of the present invention is to provide such land skis which are relatively simple and inexpensive.

Furthermore, it is an object of the present invention to provide land skis which will provide a safe reliable support for the user thereof.

In addition, it is an important object of the present invention to provide for land skis the possibility of operating in a manner which very closely simulates the operation of conventional skis on snow, so that it does become possible with the land skis of the invention to provide in climates where there is no snow at any time of the year the possibility of using skis in a manner which is practically the same as conventional snow skis.

In particular it is an object of the present invention to provide land skis which can be operated to execute turns in a manner closely simulating operations in connection wih conventional skis.

According to the invention the land ski includes an elongated support means which simulates a conventional ski and which has upper and lower surfaces as well as front and rear ends and a longitudinal central axis situated in an upright plane. The upper surface of the elongated support means carries a skibinding means which is conventional and which serves to connect a ski-shoe to the elongated support means at the upper surface thereof. Beneath the lower surface of the support means there are only three wheels, and three connecting means are provided for connecting these three wheels to the elongated support means. The three wheels include front and rear wheels as well as an intermediate wheel. The rear wheel is situated beneath a part of the support means to which a rear portion of the ski-binding means is connected so that the rear wheel will be situated to the rear of the heel of the user. The intermediate wheel is situated forwardly of the rear wheel but to the rear of the front part of the ski-binding means, so that this intermediate wheel is situated beneath the shoe between the front and rear ends of the latter. The front wheel is situated at a substantial distance forwardly of the intermediate wheel and may be located in the region of the front end of the elongated support means. The two means connecting the intermediate and rear wheels to the support means provide for the intermediate and rear wheels only the possibility of rotating about their central horizontal axes which extend transversely with respect to the elongated support means while being normal to the upright plane which contains the central axis of the elongated support means, this upright plane passing symmetrically substantially midway through the intermediate and rear wheels.

The third connecting means which connects the front wheel to the elongated support means provides for the front wheel not only the possibility of rotating about its substantially horizontal central axis but also the possibility of swivelling about an upright axis situated in the above upright plane, the latter passing midway, symmetrically, through the front wheel during foward straight travel of the elongated support means along its central axis. All three wheels are relatively narrow so that their outer surfaces are capable of engaging a surface of travel at one curved side or an opposite side of the outer surface of each wheel when the ski is laterally tilted in one direction or the other. The relationship between the intermediate and rear wheels is such that when the operator leans rearwardly he will be reliably supported in a stable manner by the rear and intermediate wheels. On the other hand when the operator leans fowardly the frictional engagement between the rear wheel and a surface of travel is reduced while the weight of the operator is more fully supported to a greater extent by the intermediate wheel. At the same time the front wheel is pressed with greater force, during such foward leaning of the operator, against the surface of travel, so that in this forward leaning position it is possible for the operator to execute a turn during which the front wheel swivels about the above upright axis, thus enabling the land ski of the invention to execute turns in a manner which closely simulates a conventional ski.

BRIEF DESCRIPTION OF THE DRAWINGS

The invention is illustrated by way of example in the accompanying drawings which form part of this application and in which:

FIG. 6 is a fragmentary longitudinal sectional elevation showing another type of connecting means for connecting a wheel to a ski;

FIG. 7 shows the structure of FIG. 6 as it appears when looking toward the latter from the right of FIG. 6;

FIG. 8 is a bottom plan view of the structure of FIG. 6 without the wheel assembly;

FIG. 9 is a section of the structure of FIG. 8 taken along line 9—9 of FIG. 8 in the direction of the arrows; and FIG. 10 is a bottom plan view of the structure shown in FIG. 6.

DESCRIPTION OF PREFERRED EMBODIMENTS

Figure 1:
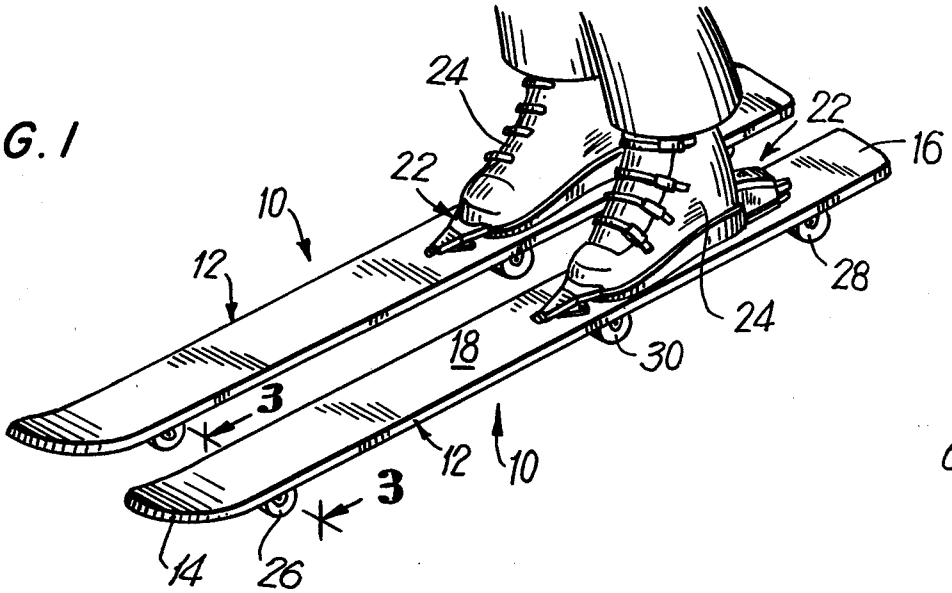
FIG. 1 is a perspective illustration of land skis of the invention during use thereof.
Figure 2:
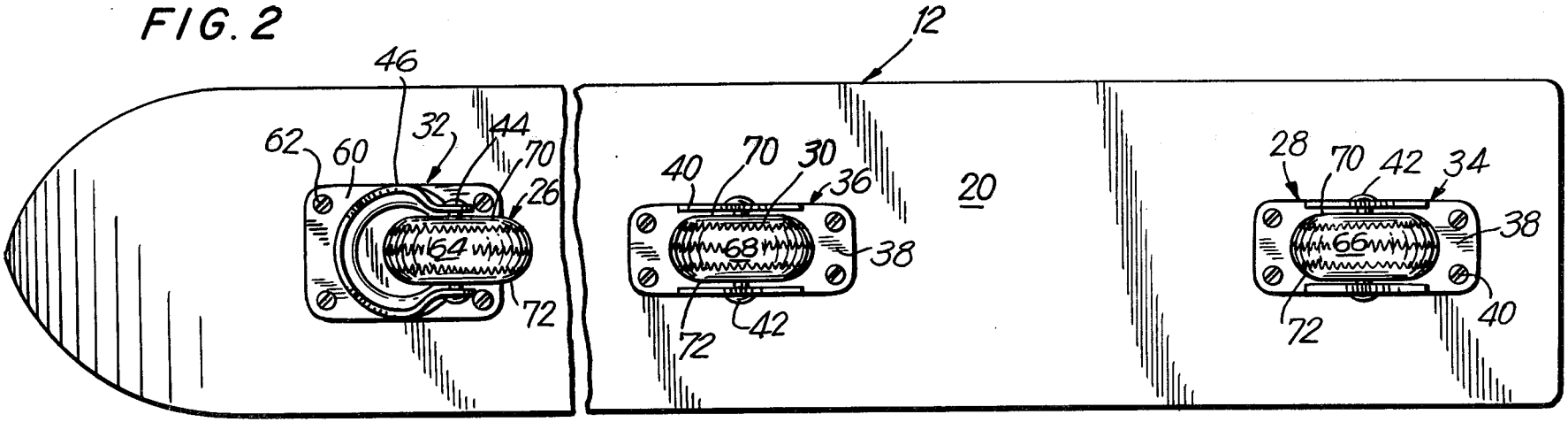
FIG. 2 is a fragmentary bottom plan view of a land ski of the invention.

Referring to FIG. 1, land skis of the invention are illustrated therein during use thereof. Thus, it will be seen that there are two land skis 10. These land skis 10 are identical, so that only one of the land skis is described in detail. It will be seen that each land ski 10 includes an elongated support means 12 which simulates a conventional ski. Thus the elongated support means 12 is in the form of an elongated relatively narrow member which may be made of wood, for example, with this support means 12 in itself corresponding to a conventional ski. The elongated support means 12 of each land ski 10 has a front end 14 which is straight or, if desired, curved upwardly to a slight extent, as illustrated. Also, each support means 12 has a rear end 16. Between its front and rear ends 14 and 16 the support means 12 can be slightly bowed in a upward direction so that when unstressed the upper surface 18 is slightly convex, curving upwardly from its front and rear end regions toward its central region, while the lower surface 20 which is shown in FIG. 2 is correspondingly slightly concave. However when the user puts his weight on the pair of support means 12 they tend to assume a flat planar configuration.

The upper surface 18 of each support means 12 fixedly carries in a conventional manner a conventional ski binding means 22. The pair of ski binding means 22 serve to connect to the pair of elongated support means 12 the pair of ski boots or shoes 24 illustrated in FIG. 1. This feature is conventional and the land skis of the invention in precisely the same way as conventional skis are attached to and detached from conventional ski boots or shoes.

According to a particular feature of the present invention each land ski 10 has only three wheels, namely a front wheel 26, a rear wheel 28, and an intermediate wheel 30. These three wheels 26, 28, and 30 are respectively attached to each support means 12 by way of three connecting means 32, 34, and 36.

The connecting means 34 and 36 for the rear and intermediate wheels 28 and 30 are of an identical construction. Thus each of these connecting means includes a flat plate 38 fastened as by screws 40 directly to the support means 12 at the lower surface 20 thereof. Each plate 38 has at its opposed side edges a pair of depending ears 40. The wheels 28 and 30 are supported for free rotary movement on a pair of relatively short pins 42 which pass through openings in the ears 40 and which have enlarged outer head ends, as illustrated in FIG. 2, so that the pins 42 are permanently connected with the plates 38 of the pair of connecting means 34 and 36. Through suitable bearings the wheels 28 and 30 are freely rotatable on the horizontal pins 42 which extend transversely with respect to the length of the elongated support means 12. The elongated support means 12 has a central longitudinal axis situated in an upright plane during use of the land ski, and this plane passes midway through the pari of wheels 28 and 30 so that the latter are symmetrical with respect to the upright plane which includes the longitudinal central axis of the support means 12.

It will be seen that the rear wheel 28 is connected by the connecting means 34 to the support means 12 at a location beneath a region of the latter which carries the rear part of the ski-binding means 22. With this arrangement the rear wheel 28 will be situated to the rear of the heel of the boot or shoe 24. The connecting means 36 connects the intermediate wheel 30 to the support means 12 at a location according to which the intermediate wheel 30 will be situated beneath the part of the support means 12 which is situated between the front and rear parts of the ski binding means 22. In this way the intermediate wheel 30 will be situated beneath the foot of the user and in fact may be located substantially centrally with respect to the foot of the user or beneath the ball of the foot of the user.

The front wheel 26 is also supported for rotary movement by a pin 44 which is horizontal during use of the land ski. Thus the front wheel 26 has a suitable bearing surrounding the pin 44 so as to be freely rotatable with respect thereto. The several pins 42 and 44 extend along the central horizontal axes of the several wheels so that by way of these pins the several wheels are supported for free rotation around their central axes. The pin 44 extends through a pair of aligned openings of a bracket 46 with the pin 44 also having enlarged head ends for fixing the pin 44 to the bracket 46.

Figure 3:
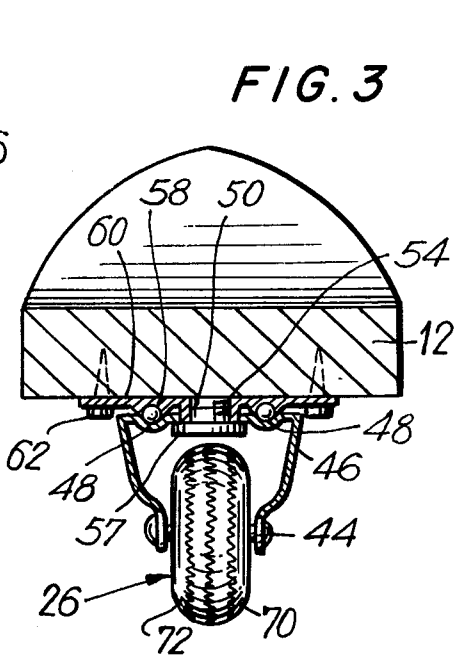
FIG. 3 is a transverse sectional elevation taken along 3—3 of FIG. 1 in the direction of the arrows.

However, the bracket 46 is not fixed to the elongated support means 12. The bracket 46 has a top wall 48 formed with an opening through which a ring 50 extends. The lower surface 20 of the support means 12 has a plate 60 fixed thereto, as is apparent from FIG. 3. The ring 50 engages a lower head end 52 of a short bolt 54 threaded into ring 50, the outer diameter of head 52 being greater than the diameter of the opening in the top wall 48 of the bracket 46 so that the latter is retained by the head 52.

Between plate 60 and wall 48 is a ball bearing 58 having races formed from plate 60 and wall 48 and surrounding ring 50 which is integral with plate 60. Thus the bracket 46 can swivel around the upright substantially vertical axis of the shank 54, this upright axis being situated in the above upright plane which contains the central longitudinal axis of the support means 12. Also it will be noted from FIG. 2 that the upright swivelling axis for the wheel 26 is situated forwardly of the pin 44 which coincides with the horizontal axis of rotation of the wheel 26.

The plate 60 is fastened to the support means 12 at the lower surface 20 thereof by suitable screws 62, so that the plate 60 is fastened to the support means 12 in the same way as the plates 38.

Thus, with this construction during use of the ski the wheel 26 will trail behind the axis around which it is capable of swivelling while being freely turnable about its own horizontal central axis. During forward travel along a straight line path the front wheel 26 is in line with the intermediate and rear wheels with the upright central plane also passing midway through the wheel 26 so that the latter is symmetrical also with respect to this upright plane during forward straight-line travel of each land ski 10.

In accordance with a further feature of the invention, the several wheels 26, 28, and 30 are provided with tires 64, 66, and 68, respectively, which are preferably made of an elastomeric material such as rubber. Preferably these tires are hollow and inflated with air maintained at a suitable pressure so as to provide for a springy support which will absorb shocks and which will contribute to the smoothness of the travel of each land ski along a surface of travel which may be relatively hard, such as a road surface, although the land skis of the invention also can be used on grass surfaces and on slopes.

In addition, although not illustrated it is possible to support the several wheels by way of springs which are compressed between the support means 12 and the structure which carries the wheels so that in this way further shock-absorbing features can be incorporated into the land ski of the invention. Thus when using such shock-absorbing springs the structures which carry the wheels are capable of yielding toward and away from the support means 12. However, such shock-absorbing springs are not essential and the structure illustrated is perfectly suitable with sufficient shock-absorbing action being achieved by the springy elastomeric nature of the tires which can either be solid or hollow and inflated as pointed out above.

According to a further feature of the invention it will be seen that the several wheels are relatively narrow. Thus each of the wheels 26, 28, and 30 has an outer substantially cylindrical ground-engaging surface terminating in a pair of opposed curved sides 70 and 72. The width of each wheel is small enough to assure that each wheel will engage the surface of travel at one or the other of the curved sides 70 or 72 upon lateral tilting of each support means 12 in one direction or the other. Thus, with the land skis of the invention the operator can during use thereof tilt the land skis, in the same way as conventional skis on snow, in one lateral direction or the other, thus contributing greatly to an operation which closely simulates that which is provided with conventional skis on snow.

It will be seen that the front wheel 26 is situated on the support means 12 of each land ski at the region of the front end 14 thereof at a considerable distance forwardly from the intermediate wheel 30. While it might be possible in some cases to situate the front wheel 26 closer to the intermediate wheel 30 than the distance illustrated, in all cases the front wheel 26 will be situated at a substantial distance forwardly from the intermediate wheel 30, preferably at a distance somewhat greater than one half the distance between the front part of each ski binding and the front end 14.

With the above arrangement of the wheels of each land ski considerable advantages are achieved. Thus the situation of the rear wheel 28 to the rear of the heel of the operator provides considerable stability in the event that the operator leans rearwardly. However, when the operator leans forwardly, the pressure of the rear wheel 28 against the surface of travel is reduced while the pressure of the intermediate wheel 30 against the surface of travel is increased inasmuch as the weight of the operator is shifted forwardly diminishing the extent to which the weight of the operator is carried by the wheel 28 and increasing the extent to which the weight of the operator is carried by the wheel 30. At the same time, this forward leaning of the operator tends to urge the wheel 26 downwardly with a greater pressure toward the surface of travel inasmuch as the forward leaning of the operator shifts the weight of the operator forwardly and acts with a moment about the intermediate wheel 30 as a fulcrum pressing the front wheel 26 against the surface of travel. In this forward leaning position the operator will execute a turn, so that when executing a turn in either direction the rear wheel 28 does not press against the surface of travel with any force of friction which could interfere with the turning operation while at the same time the front wheel 26 is pressed with a greater force against the surface of travel facilitating the swivelling thereof about the upright axis provided by the bearing means 58 while at the same time the entire ski can turn about a center situated at the intermediate wheel 30. In this way exceedingly effective turns can be executed with the land skis of the invention in a manner which closely simulates turns achieved with conventional skis.

It is not essential to provide for the wheels of the invention connecting means which permanently connect the wheels to the skis as described above in connection with FIGS. 1–3. Thus FIGS. 4 and 5 show an alternative embodiment where a releasable fixing means is utilized for fixing the wheels to the elongated support means 12 which is in the form of a conventional ski.

Figure 4:
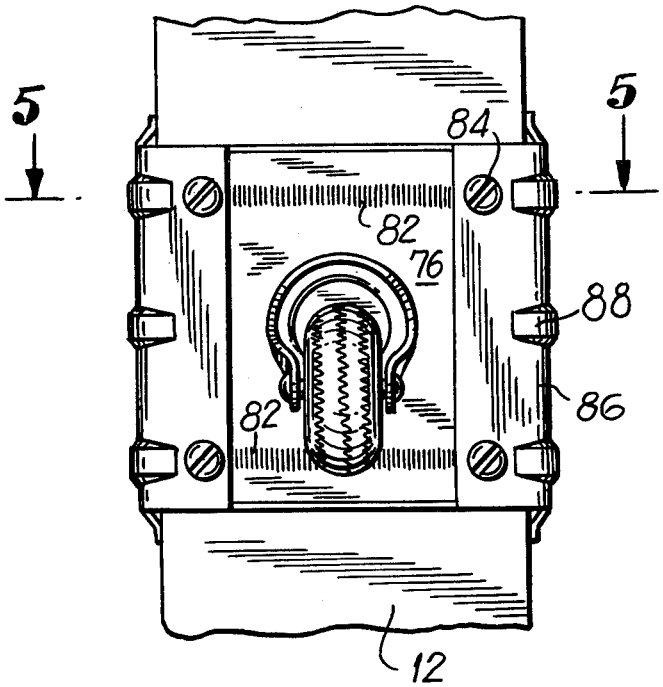
FIG. 4 is a fragmentary bottom plan view of a further embodiment of the invention with FIG. 4 illustrating a front wheel of the land ski of the invention.
Figure 5:
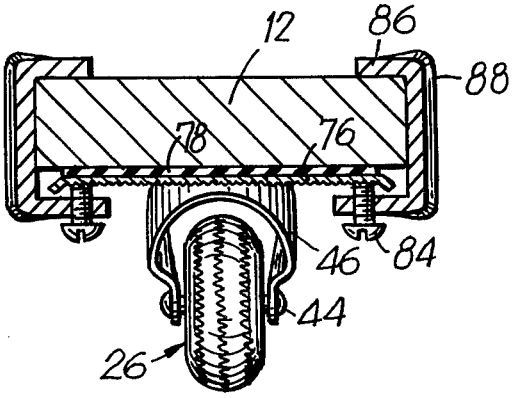
FIG. 5 is a transverse sectional elevation taken along line 5—5 of FIG. 4 in the direction of the arrows.

Referring to FIGS. 4 and 5 it will be seen that the front wheel 26 is in this case also carried by way of the pin 44 on a bracket 46 which is capable of swivelling. However in this case the top wall of the bracket 46 has in its opening an internally threaded ring which is fixed to and extends downwardly from the lower surface of a plate 76 which engages a rubber sheet 78 situated between the plate 76 and the bottom surface of the ski 12, to protect the latter against scratching. The bracket 46 is connected to plate 76 in the same way as to plate 60, so that this construction also provides for swivelling of the front wheel 26.

The lower surface of the plate 76 has a pair of roughened portions 82 engaged by the free ends of fastening bolts 84 which extend threadedly through openings in lower portions of elongated C-clamp members 86 which are suitably reinforced at 88. Thus with the spacer plate 79 and plate 76 as illustrated in FIG. 5 with respect to the ski 12, the elongated C-clamps 86 can be fastened by way of the bolts 84 to the ski 12 and to the plate 76 so as to releasably fix the front wheel 26 to the ski 12 in the manner apparent from FIGS. 4 and 5. A similar arrangement is used with respect to the intermediate and rear wheels, the only difference being that in these cases each of the plates 38 which carry the intermediate and rear wheels is directly fixed, as by welding, for example, to the lower surface of a plate similar to plate 76. Thus the construction shown in FIGS. 4 and 5 is repeated for each of the wheels so as to provide a means for releasably fixing the wheels to the ski 12. The extent to which the upper portions of the C-clmps 86 overlap the top surface of the ski is insufficient to interfere either with the boots 24 or the ski-bindings 22. Thus with the arrangement of FIGS. 4 and 5 conventional skis 12 can easily be converted to land use with the structure of the invention.

Also the inclined ends of clamps 86 (FIG. 4) enables the clamps at the inside edges of a pair of skis to slide past each other when the skis are very close to each other.

It is thus apparent that with the structure of the present invention an exceedingly simple inexpensive land-ski is provided while at the same time being capable of closely simulating operations of conventional skis, thus enabling, during times when there is no snow on the ground, an individual to continue to keep in form utilizing on non-snow-covered surfaces the land skis of the invention in a manner which closely simulates the use of conventional skis.

According to a further embodiment of the invention shown in FIGS. 6–10, a ski 100 also has three wheels capable of being connected thereto in the manner described above so as to achieve the above results of the invention. However in the embodiment of FIGS. 6–10, the several wheels are connected to the ski 100 by way of a connecting means 102 which permits the wheels to be removed, so that they can readily be replaced.

According to this embodiment the ski 100 has fixed to the lower surface thereof, for each of the wheels, a flat plate 104 permanently connected with the ski by way of screws 106 (FIG. 8) which extend only part of the way into the body of the ski 100, as is particularly apparent from FIG. 9. The plate 104 is flat except that at its edge it has a channel portion 108 forming a groove extending all around the periphery of the plate 104 except at the front edge 110 thereof. Thus it will be understood that this edge 110 is directed toward the front of the ski, forming the front edge of each plate 104. The heads of the screws 106 are countersunk into the plate 104 so as not to project beyond the lower surface thereof. Each wheel 112 of this embodiment is supported for rotation on a pin carried by a U-shaped bracket 114 which in turn is fixed to a plate 116. The configuration of the plate 116 is such that its side and rear edges will be received in the interior of the channel 108.

The plate 104 is formed between the front screws 106 with an opening 118, and this opening is aligned with an internally threaded hole 120 which is formed in the ski 100. When the plate ll6 is fully inserted into the channel 108 so as to have therein the position shown in FIG. 10, a fixing screw 122 is introduced through the opening 118 into the threaded hole 120 so as to fixedly hold the plate 116 in the position illustrated in FIG. 10. Of course it is to be noted that during forward travel any tendency for the plate 116 to shift rearwardly with respect to the plate 104 will be absorbed by the construction of the channel 108, particularly at the rear portion thereof.

Thus, with this construction it is a simple matter at any time to remoe and replace a wheel. Of course the front wheel will have its bracket connected to the plate 116 by a bearing structure providing for the possibility of swiveling of the front wheel about an upright axis, as described above.

However, it will be seen that in this embodiment the wheels 112 are shown as being provided with circumferential grooves 124, similar to such grooves of conventional automobile tires, and thus in this way it is possible to increase the traction between the wheels and the surface on which they travel. Of course these wheels 112 also may be made of solid rubber or they may be hollow and inflated, as pointed out above.

Thus, with this particular embodiment, although the ski 100 cannot be used as a conventional snow ski, nevertheless this embodiment provides the advantage of making it easily possible to change a wheel whenever necessay. Thus if any of the wheels should become worn to such an extent that changing thereof is advisable, it is only necessary with a screwdriver or coin to remove the fastening screw 122, whereupon the entire wheel assembly, including the plate 116, can be removed and replaced by a new assembly, and then of course the screw 122 is replaced.

What is claimed is:

1. A land ski comprising elongated support means simulating a conventional ski and having upper and lower surfaces, front and rear ends, and a longitudinal central axis situated in an upright plane during use of the land ski, ski-binding means carried by said support means on said upper surface thereof for connecting a ski shoe thereto, said ski-binding means being situated on said upper surface of said support means closer to said rear end than said front end thereof, and only three wheels situated beneath said lower surface of said support means and only three connecting means respectively connecting said three wheels to said support means, said three wheels including front, rear, and intermediate wheels with said rear wheel being situated beneath a part of said support means situated in the region of a rear part of said ski-binding means, with said intermediate wheel situated forwardly of said rear wheel beneath a part of said support means situated to the rear of a front end region of said ski-binding means, and with said front wheel situated at a substantial distance forwardly of said rear wheel beneath a part of said support means situated between said ski-binding means and said front end of said support means, said three connecting means including two connecting means respectively connecting said intermediate and rear wheels to said support means for rotary movement only about central axes of said intermediate and rear wheels which extend transversely with respect to said support means while being normal to said upright plane and the latter extending midway through said intermediate and rear wheels so that the latter are symmetrical with respect to said upright plane, the third of said connecting means connecting said front wheel to said support means also for rotary movement about a central substantially horizontal axis of said front wheel which extends transversely with respect to said ski and which is normal with respect to said upright plane during forward travel of said elongated support means in the direction of said axis thereof, said third connecting means also connecting said front wheel to said elongated support means for swivelling movement with respect thereto about a substantially upright axis which is situated in said upright plane the latter also passing substantially midway through said front wheel when said axis thereof is normal to said upright plane so that during forward travel of said support means in the direction of said axis thereof said front wheel also is symmetrical with respect to said upright plane, all of said wheels having outer substantially cylindrical surfaces for engaging a surface on which the land-ski travels, and said outer surfaces of said wheels being relatively narrow and each terminating in opposed circular curved sides, the width of each of said wheels at said outer surface thereof being sufficiently small to provide for engagement of each wheel with the surface on which the land-ski travels at one or the other of the curved sides thereof during lateral tilting of said support means in one direction or the other, said rear wheel having a position with respect to said support means for reliably supporting the user of the land ski when the user leans rearwardly, while the relationship between said intermediate and rear wheels is such that the latter has a lesser frictional engagement with a surface of travel than said intermediate wheel when the user leans forwardly while during such forward leaning with the weight of the user supported by said intermediate wheel and with the lesser frictional engagement between said rear wheel and said surface of travel said front wheel is pressed by the user with a greater force against said surface of travel while being capable of swivelling about said upright axis to execute a turn.

2. The combination of claim 1 and wherein said upright swivel axis of said front wheel is situated forwardly of the central horizontal axis of said front wheel so that the latter trails behind said swivel axis.

3. The combination of claim 1 and wherein said front wheel is situated adjacent the front end of said support means.

4. The combination of claim 1 and wherein said ski-binding means has a rear part for engaging the rear portion of a ski shoe, and said rear wheel is situated at least as close to the rear end of said support means as said rear part of said ski-binding means.

5. The combination of claim 1 and wherein said ski-binding means has front and rear parts between which a ski-shoe is adapted to be situated and said intermediate wheel is situated beneath a portion of said support means which is situated between said front and rear parts of said ski-binding means.

6. The combination of claim 1 wherein said wheels have tires made of an elastomeric material such as rubber.

7. The combination of claim 6 wherein said tires are hollow and inflated.

8. The combination of claim 1 and wherein said three connecting means are fixedly connected to said support means on said lower surface thereof.

9. The combination of claim 1 and wherein said three connecting means respectively carry said three wheels and have a releasable connection with said support means so that said connecting means and wheels can be removably connected with said support means for permitting the latter to be used as a conventional ski as well as a land-ski when said three connecting means and wheels are connected with said support means.

10. The combination of claim 1 and wherein each of said connecting means includes an upper connecting member fixed permanently to said support means on said lower surface thereof and a lower connecting member engaging said upper member and carrying one of said wheels, and each connecting means includes a means for releasably connecting said lower connecting member to said upper connecting member, so that when necessary said lower connecting member and the wheel carried thereby can be removed and replaced.

11. The combination of claim 10 and wherein each of said upper connecting members includes a plate formed with a perifferal channel and each of said lower connecting members has an edge portion received in said channel.

12. The combination of claim 11 and wherein the channel of each upper connecting member extends along the peripheral portion thereof except at a front end region thereof.

* * * * *